United States Patent [19]

Davis, Jr.

[11] 4,041,664

[45] Aug. 16, 1977

[54] JOIST, STRUCTURAL ELEMENT AND DEVICES USED IN MAKING SAME

[76] Inventor: George Bradley Davis, Jr., P.O. Box 1096, Boulder, Colo. 80302

[21] Appl. No.: 617,737

[22] Filed: Sept. 29, 1975

Related U.S. Application Data

[60] Division of Ser. No. 400,381, Sept. 24, 1973, Pat. No. 3,919,824, which is a division of Ser. No. 256,257, May 24, 1972, Pat. No. 3,813,834, which is a continuation-in-part of Ser. No. 41,426, May 28, 1970, abandoned.

[51] Int. Cl.[2] ..... E04B 1/41; E04C 3/18

[52] U.S. Cl. ..... 52/223 R; 52/374; 52/508

[58] Field of Search ..... 52/223 R, 364, 372, 52/373, 374, 346, 347, 573, 508

[56] References Cited

U.S. PATENT DOCUMENTS

| | | | |
|---|---|---|---|
| 955,338 | 4/1910 | Leiter | 52/508 X |
| 1,563,593 | 12/1925 | Schall | 52/513 X |
| 2,010,294 | 8/1935 | Dovell | 52/508 X |
| 2,101,001 | 11/1937 | Balduf | 52/573 X |
| 2,432,622 | 12/1947 | Johnston | 52/573 |
| 3,283,456 | 11/1966 | Carlton | 52/223 R |
| 3,567,816 | 3/1971 | Embree | 52/223 R |

FOREIGN PATENT DOCUMENTS

| | | | |
|---|---|---|---|
| 922,480 | 2/1947 | France | 52/508 |

*Primary Examiner*—Alfred C. Perham
*Attorney, Agent, or Firm*—Duane Burton

[57] ABSTRACT

A structural element having a fire rating of approximately two hours when tested with the standard time-temperature curve established by the American Standards for Testing Materials, said element including prestressed concrete joists each having a plate-like body portion and reinforced support ledges, each ledge has a nailing strip molded adjacent the bottom thereof and each nailing strip including a penetratable area formed internally adjacent thereof, a plurality of sheets of material disposed adjacent the ends of said ledges, each sheet of material forming a butt joint with an adjacent sheet which extends longitudinally along one of said ledges, channel-shaped members disposed along each butt joint intermediate said ledge portion and said sheets and attachment means for attaching said channel-shaped members to the nailing strips and, also, for attaching sheets of material to said nailing strips and channel-shaped members whereby said sheets of material are secured to the joist while preventing undesirable distortion or warping thereof during the fire rating tests. A pretensioned concrete joist of the T-type comprising a concrete plate-like body portion, a channel-shaped support ledge, a nailing strip integrally molded in the bottom of said ledge, said nailing strip including a channel-shaped member having a penetratable layer of material disposed therein and a plurality of positioning members longitudinally spaced along said channel-shaped member, and pretensioning steel disposed in engagement with said positioning members, said pretensioning steel and said positioning members cooperating to maintain the nailing strip on the bottom surface of the ledge prior to and during placement of the concrete of said joist. A novel form member for producing a pretensioned concrete member having a nailing strip molded therein, and a novel positioning member made from a single piece of plastic material.

6 Claims, 11 Drawing Figures

JOIST, STRUCTURAL ELEMENT AND DEVICES USED IN MAKING SAME

CROSS-REFERENCE TO RELATED APPLICATION

This is a division of application Ser. No. 400,381, filed 9-24-73 now U.S. Pat. No. 3,919,824, as a division of application Ser. No. 256,257, filed 5-24-72, now U.S. Pat. No. 3,813,834 as a continuation in part of application Ser. No. 41,426, filed 5-28-70, now abandoned.

BACKGROUND OF THE INVENTION

Joists or structural beams of the T-type (as used herein the term T-type shall also include twin T and quad T-types) are well known in the art. The ledge or ledges of this type of joists contain the main reinforcing of the structural member and act as the supporting member from which the ceiling is suspended. In the part, various expedients have been used to attach the wall or ceiling board to the ends of the ledges of the joists. The most common expedient is the use of the so-called "nailing strips" incorporated into the ends of the ledges. The nailing strips are ordinarily mechanically attached to the outside of a ledge as exemplified by the structure shown in U.S. Pat. No. 2,123,923. They are adapted to receive bolts, screws, nails and the like to secure the wall board or other structural element to the ledges. The nails or screws are driven or screwed into a wooden beam, disposed behind the plate, after passing through the nailing plate itself.

Various means have been used to affix the nailing plate to the end of the ledges as shown in the above-referenced patent and in U.S. Pat. No. 1,466,264, for example. Anchors for supporting structural elements on the end of the ledges have been incorporated into the ends of the ledges by various means as illustrated by U.S. Pat. Nos. 1,251,150 and 1,953,138. Other patents relating generally to the field of this invention are U.S. Pat. No. 1,470,727 and British Pat. No. 838,452.

The known expedients for attaching nailing plates to the ends of the ledges of T-type joists are subject to various disadvantages. Wooden nailing plates are subject to shrinkage, rotting, destruction by termites and the like so that they are not generally satisfactory for permanent installations. The metal anchors, hooks and the like are subject to the disadvantage, along with the wooden nailing plates, that their installation is difficult and time-consuming and, consequently, expensive.

Heretofore, various structural elements have been proposed which have a fire rating of approximately two hours when tested with the standard time-temperature curve established by the American Standards for Testing Materials. However, any such structural element incorporating therein a T-type joist and which has successfully met this requirement involves the use of a T-type joist requiring approximately twice as much concrete to form as required in the structural element of this invention. More concrete was required to form the prior art type of joist since either thicker plate-like body portions and/or more massive ledges were required in order to withstand the temperatures involved.

Accordingly, it is a principal object of this invention to provide a novel structural element having a fire rating of approximately two hours when tested with the standard time-temperature curve established by the American Standards for Testing Materials, particularly when tested under the unrestrained assembly classification.

Another object of this invention is to provide a structural element as aforesaid comprising one or more prestressed concrete joists, each joist having a plate-like body portion forming at least a part of a first side of said element one or more integrally formed, reinforced support ledges disposed normal to the plate-like body portion, and a nailing strip integrally molded in the bottom of each ledge, each nailing strip including a penetratable area formed internally adjacent thereof, a plurality of sheets of material disposed adjacent the ends of said ledges, each sheet being formed from a material from the class consisting of gypsum or a mineral fiber mixture, said sheets forming the second side of said element and having a thickness equalling one-half inch or more, each sheet of material forming at least one butt joint with an adjacent sheet wherein said butt joint extends longitudinally along a portion of one of said ledges, a plurality of channel-shaped members disposed along each butt joint and intermediate said ledge portion and said sheets, attachment means for attaching said channel-shaped member to the nailing strips of said ledge portions, and additional attachment means for attaching said sheets of material to said nailing strips and said channel-shaped members, said additional attachment means, channel-shaped members and nailing strips cooperating to secure the sheets of said joist while preventing undesirable distortion or warping thereof during the fire rating test.

Another object of this invention is to provide a structural element as aforesaid in which each of the additional attachment means used to attach the sheets of material to the channel-shaped members disposed along said butt joints is positioned a minimum distance of approximately one and one-fourth inches from the adjacent edge of each sheet.

Another object of this invention is to provide a structural element as aforedescribed in which each ledge of each joist has a plate-like body portion associated therewith, each ledge being disposed generally centrally of said associated part, each associated part extending laterally of both sides of its associated ledge, taken along a line disposed normal to the longitudinal axis of its associated ledge to a point midway between said associated ledge and an adjacent ledge or the end of said plate-like body portion, whichever is the closer, the ratio of the cross-sectional area of the part of said plate-like body portion taken along a line disposed normal to the longitudinal axis of said ledge, to the width of its associated ledge, said width of said ledge being measured along a line normal to the of axis o said associated ledge at the line of intersection of said ledge with said part, varying between approximately 7.5 to 10 inches, and the ratio of the cross-sectional area of each ledge to the cross-sectional area of its associated part, taken along a line disposed normal to the longitudinal axis of said ledge, being equal to approximately 2 or less.

Another object of this invention is to provide a structural element as aforesaid in which the ratio of the cross-sectional area of the part of the plate-like body portion to the width of it associated ledge varies between approximately 8 to 9 inches and the ratio of the cross-sectional area of each ledge to each cross-sectional area of its associated part is equal to approximately one or less.

Another object of this invention is to provide a pretensioned concrete joist of the T-type comprising a concrete plate-like body portion, a channel-shaped concrete support ledge disposed normal to said body portion along the length thereof, a nailing strip integrally molded in the bottom of said ledge, said nailing strip comprising a channel-shaped member, a longitudinally extending U-shaped portion formed along the upper edge of each side wall of each channel-shaped member with the longitudinal axis of each U-shaped portion lying in a plane in which is disposed generally parallel with the plane in which is disposed the bottom wall of said channel-shaped member and the bight of each U-shaped portion extending inwardly of its associated side wall, and a longitudinally extending penetratable layer of material disposed within said channel-shaped member, said layer of material having a lower surface portion disposed in contact with the bottom wall of said channel-shaped member and upper surface portions disposed in abutting contact with said U-shaped portions of said channel-shaped member, said nailing strip also including a plurality of positioning members longitudinally spaced along said channel-shaped member and having portions thereof disposed within the U-shaped portions extending longitudinally along the upper edge of each side wall of said channel-shaped member, and pretensioning steel extending longitudinally of said ledge and disposed in contacting engagement with the upper surface of said positioning members, said pretensioning steel and said positioning members cooperating to secure and maintain the nailing strip on the bottom surface of the ledge prior to and during placing of the concrete during forming of the joist.

Another object of this invention is to provide a pretensioned concrete joist as aforedescribed in which each of said positioning members comprises an elongate support portion, and a pair of L-shaped portions each L-shaped portion including a pair of arms, each L-shaped portion depending from a corresponding one of the arms of said support portions and having one of said arms disposed parallel with said support portion, each L-shaped portion being constructed for limited pivotal movement relative to said support portion, each free end of the arms that are disposed generally parallel with said support portion being positioned within a corresponding one of the longitudinally extending U-shaped portions formed along the upper edge of each side wall of said channel-shaped member.

Another object of this invention is to provide a form member for use with a mold for making a pretensioned concrete member having a nailing strip molded therein, said form member comprising a longitudinally extending, channel-shaped member for disposition in the bottom of said mold member and a plurality of positioning members longitudinally spaced along said channel-shaped member and secured thereto.

Another object of this invention is to provide a novel positioning member for positioning an object in a hollow member such as a mold member, said positioning member being formed from a single piece of plastic material and comprising an elongate support portion the upper surface of which is concave in configuration, and a pair of L-shaped portions, each L-shaped portion including a pair of arms, each L-shaped portion depending from a corresponding one of the ends of said support portions and having one of said arms disposed parallel with said support portion, each L-shaped portion being constructed for limited pivotal movement relative to said support portion, and the free ends of said arms that are disposed generally parallel with said support portion, lying generally in a common plane and spaced apart one from the other, said free ends being constructed for engaging a portion of the objects.

Another object of this invention is to provide a novel positioning member as aforesaid in which each of the arms of said L-shaped portions that are integrally attached to said support portion are convergently disposed one to the other in a direction proceeding from said support portion toward the arms disposed generally parallel with said support portion.

Another object of this invention is to provide a novel positioning member as aforedescribed in which the angle of convergence of the arms that are integrally attached to said support portion equals at least approximately 4° or more, and preferably approximately 6°.

Another object of this invention is to provide a novel positioning member as aforedescribed in which the upper surface of said support portion is concave in configuration.

Another object of this invention is to provide a novel positioning member as aforedescribed including means interconnecting a portion adjacent the free end of each arm disposed generally parallel with said support portion thereby preventing undesirable entanglement of one plastic member with another when packed "loosely" in a container.

Another object of this invention is to provide a novel positioning member including tab means extending longitudinally outwardly of the opposite ends of said support portion and longitudinally outwardly of the pair of arms disposed generally parallel with said support portion.

Another object of this invention is to provide a novel positioning member as aforedescribed in which each free end of each arm lying generally in a common plane includes a portion disposed generally normal to the longitudinal axis of its corresponding arm and likewise is disposed within said common plane.

Another object of this invention is to provide a novel positioning member as aforedescribed in which each L-sahped portion includes stiffening means for controlling the overall stiffness thereof wherein said stiffening means preferably includes a diagonally disposed member interconnecting the arms of each L-shaped portion.

Another object of this invention is to provide a novel positioning member as aforedescribed in which the outer ends of said support portion nd said L-shaped portions are connected by a pair of convergently disposed lines proceeding along said lines in a direction from each outer end of said support portion to the corresponding outer end of said L-shaped portion.

SUMMARY OF THE INVENTION

A structural element having a fire rating of approximately two hours when tested with the standard time-temperature curve established by the American Standards for Testing Materials, said element having first and second sides, said second side, during the fire rating test of said element being exposed to flames, said element comprising one or more prestressed concrete joists wherein each joist has a plate-like body portion forming at least a part of the first side of said element and one or more integrally formed, reinforced support ledges disposed normal to the plate-like body portion, each ledge having a nailing strip integrally molded at the bottom thereof, each nailing strip including a penetratable area formed internally adjacent thereof, a plurality of sheets of material disposed adjacent the ends of said ledges, said sheets being formed from a material selected from the class consisting of gypsum or a mineral fiber mixture, said sheets forming the second side of said element and having the thickness of said material equaling one-half inch or more, each sheet forming at least one butt joint with an adjacent sheet, said butt joint extending longitudinally along a portion of one of said ledges, a plurality of channel-shaped members, each channel-shaped member being disposed along each butt joint and intermediate said ledge portions and said sheets, and attachment means for attaching said channel-shaped mambers to the nailing strips of said ledge means and, also, for attaching said sheets of material to said nailing strips and said channel-shaped members, said attachment means, channel-shaped members and nailing strips cooperating to secure the sheets to said joist while preventing undesirable distortion or warping thereof during the fire rating test. The channel-shaped members prevent the edge of the sheet adjacent said butt joint from pulling away from the adjacent sheet as a result of the stresses to which same is subjected during the fire rating test. The pretensioned concrete joist of the T-type includes a nailing strip integrally molded in the bottom of said ledge, said nailing strip comprising a channel-shaped member having longitudinally extending U-shaped portions formed along the upper edge of each side wall of each channel-shaped member, the longitudinal axis of each U-shaped portion lying in a plane disposed generally parallel with a plane in which is disposed a bottom wall of said channel-shaped member, the bight of each U-shaped portion extending inwardly of its associated side wall, and a longitudinally extending attachment-means-penetrating layer of material disposed within said channel-shaped member, said layer of material having a lower surface portion disposed in contact with the bottom wall of said channel-shaped member and upper surface portions disposed in butting contact with said U-shaped portions of said channel-shaped member, said attachment-means-penetrating layer of material preventing concrete from entering into said channel-shaped member, and a plurality of positioning members longitudinally spaced along said channel-shaped member and having portions thereof disposed within the U-shaped portion thereof, and pretensioning steel extending longitudinally of said ledge and disposed in contacting engagement with the concave surface the frame members of said positioning members, said pretensioning steel and said positioning members cooperating to secure and maintain the nailing strip on the bottom surface of the ledge prior to and during placing of the concrete during forming of said joist. The nailing strip includes a channel-shaped member as aforedescribed and the plurality of positioning members as aforedescribed.

One prefered embodiment of a novel positioning member is formed from a single piece of plastic material and comprises an elongate support portion and a pair of L-shaped portions, each L-shaped portion including a pair of arms, each L-shaped portion depending from a corresponding one of the ends of said support portion and having one of said arms disposed generally parallel with said support portion, each L-shaped portion being constructed for limited pivotal movement relative to said support portion, and the free ends of said arms, that are disposed generally parallel with said support portion, lying generally in a common plane and spaced part one from the other, said free ends being constructed for engaging a portion of the channel-shaped member with which same is to be used.

Another embodiment of a positioning member useful in the form, joist and structural element of this invention is a member comprising an inverted U-shaped frame member including a bight portion overlying the upper edges of the channel-shaped member of the nailing strip and a pair of leg portions, the outer surface of said bight portion being generally concave in configuration and adapted to engage a pretensioning steel after the form member has been positioned within the mold, said frame portion lying in a plane disposed generally normal to the longitudinal axis of said channel-shaped member, a pair of legs, each leg having a first part attached to a corresponding one of the leg portions of the U-shaped frame member and a second part securely disposed within a corresponding one of the U-shaped portions of said channel-shaped member of said nailing strip, said second parts lying in a plane disposed generally normal to the plane in which is disposed said frame member, the outer surfaces of said U-shaped frame member being spaced such that they are adapted to be received between the opposed walls of the mold in which same is to be used whereby said outer surfaces of said leg portions serve as means for centering and positioning said form member within the channel-shaped portion of the mold in which same are to be used upon being dropped therein and are adapted to be disposed adjacent the inside surfaces of the opposed walls of the mold within which same are to be used.

BRIEF DESCRIPTION OF THE DRAWINGS

The invention will now be described with reference to the accompanying drawings in which.

DESCRIPTION OF THE PREFERRED EMBODIMENTS

Figure 1:
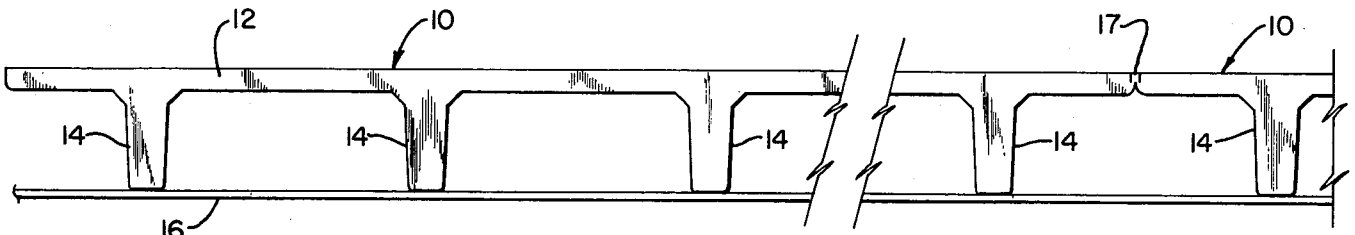
FIG. 1 is an end view of a T-type joist.

Referring to FIG. 1, there is shown a structural element constructed in accordance with the subject invention, said element including an assembly of typical T-type joists 10 usually constructed of prestressed reinforced concrete. Each joist comprises a relatively thin concrete plate-like body portion 12 having integrally molded support ledges or ribs 14 that contain the main reinforcing steel and the nailing strip or plate which supports a sheet of material 16 forming the ceiling or wall board. The sheet of material 16 is schematically shown attached to the ends of the ledges 14. The two joists 10 are connected by a joint 17 filled with grout. The structural element also includes means (not shown in FIG. 1) for satisfactorily attaching the sheet of material 16 to the ends of the ledge 14.

Figure 2:
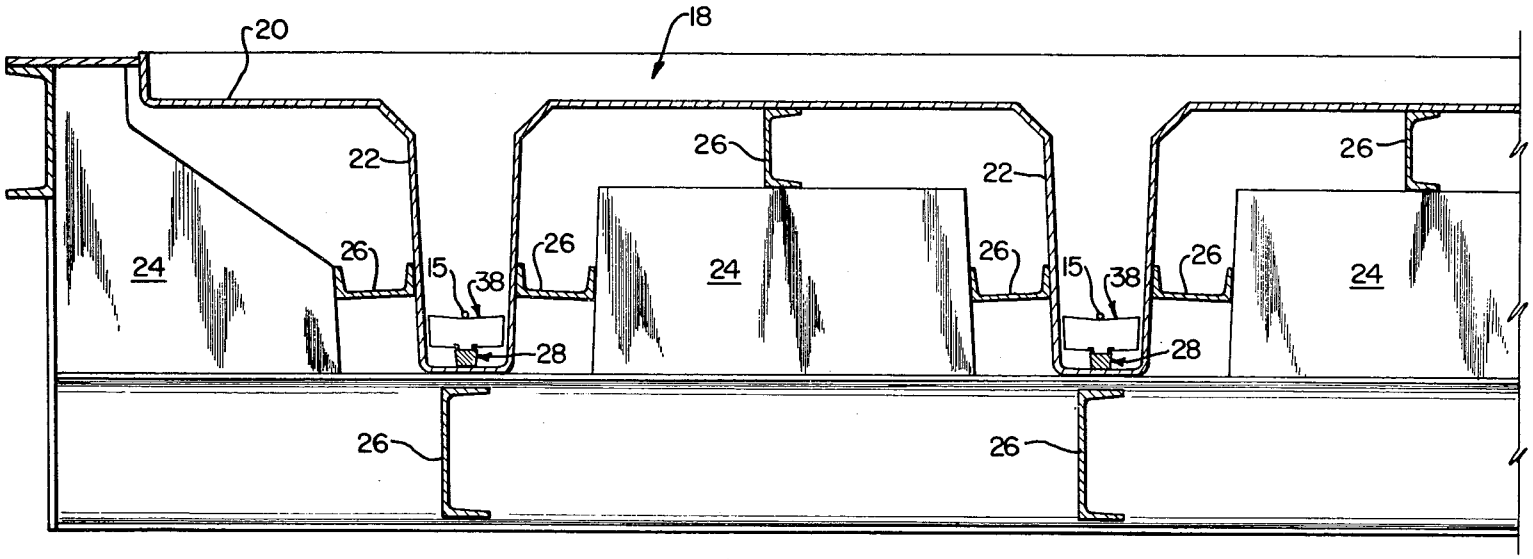
FIG. 2 is a partial cross section of the mold form in which a T-type joist is molded.

Referring to FIG. 2, a mold form 18 is shown in which a typical T-type joist shown in FIG. 1 is molded. The form 18 is comprised of a body section 20 in which the plate-like body portion of the joist is molded, and integral leg sections 22 in which the integral ledges or ribs 14 are molded. The form 18 is conventionally supported by means of gussets 24 and braces 26 suitably positioned to support the mold 18 when concrete is poured into it. The structure for supporting the mold forms no part of this invention.

Figure 3:
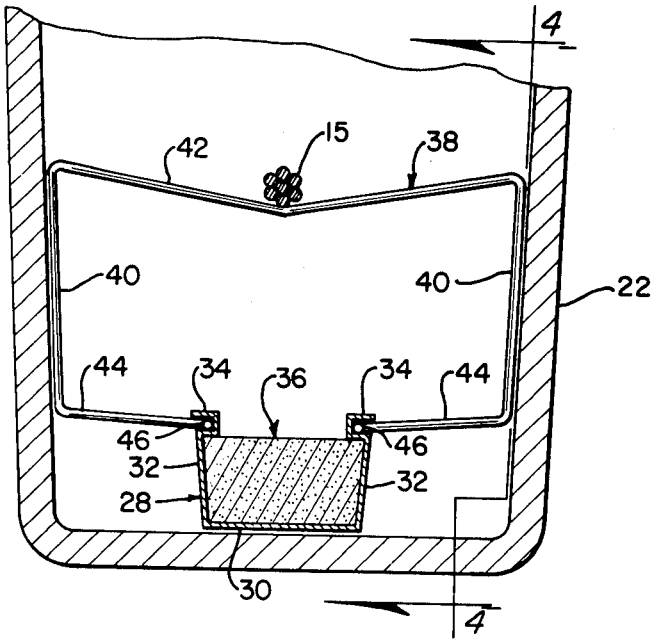
FIG. 3 is a partial cross section of the end of one of the legs of the mold of FIG. 2 showing the nailing strip and positioning member supported in the leg section of the mold.
Figure 4:
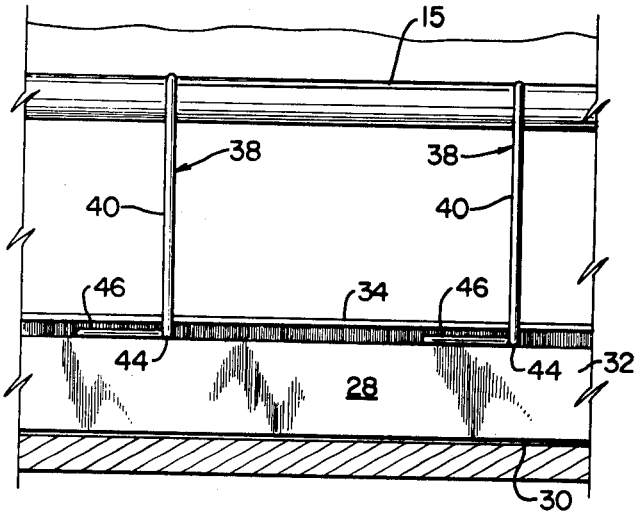
FIG. 4 is a view taken on lines 4—4 of FIG. 3.

Referring to FIGS. 3 and 4, there is shown an assembly of nailing strip and positioning member positioned inside the leg of the mold prior to pouring concrete for molding a typical T-type joist and molding a nailing strip in the support ledge thereof. The nailing strip 28, suitably made of sheet metal, such as a 25 ga. hot dipped galvanized sheet metal, extends the entire length of the leg 22 of the mold. The nailing strip 28 is oa channel-shaped construction, as shown, with its base 30 resting on the inside or bottom surface of the end of leg 22 and its open channel section facing upwardly. The legs 22 are convergently formed, proceeding in a direction along said legs toward the base 30, and this feature enhances the securement of said nailing strip within the concrete after it has set up. It includes sides 32 integrally connected to the base 30 and terminating at their upper ends in U-shaped sections 34 for a purpose to be described later. The longitudinal axis of each of the U-shaped sections 34 lie in a plane disposed generally parallel with a plane in which is disposed the base or bottom wall 30. The bight of each said U-shaped portion extends inwardly of its associated side wall. The interior 36 of the channel-shaped nailing strip 28, which is enclosed by the base 30 and the sides 32, comprises a penetrable area into which nails, screw and the like used to attach the sheet of material 16 to the base 30, penetrate. In order to prevent the space 36 from filling with concrete when the joist is molded, it is filled with a blocking material, such as expanded polystyrene, which is preferably secured to said nailing strip with contact cement. This prevents concrete from entering the interior of the channel-shaped nailing strip and still provides a penetratable area into which screws, nails and the like may penetrate when a wall or ceiling board is attached to the base 30 of the nailing strip.

In order to center properly the nailing strip 28 in the leg 22, longitudinally spaced centering and hold down frames 38 are attached to the nailing strip 30 and inserted in the end of the leg 22 with it. The positioning frames 38 are suitably constructed from an elongated piece of material, such as metal wire, plastic and the like, and comprise a rectangular frame member having sides 40 joined at the top by U-shaped bridge member 42 and comprising a pair of legs having end members. Each leg has a first part 44 attached to a corresponding one of the sides 40 and extending inwardly in the same plane as the bridge member 42. Each leg also has a second part 46 extending perpendicular to the plane of the frame 38 and disposed or seated in one of the U-shaped sections 34 of the nailing plate 28. This construction maintains the U-shaped bridge member 42, the sides 40 and the end the first parts 44 of said legs in a vertical plane, as viewed in FIGS. 3 and 4, and precludes the necessity of forming notches or openings within the sides 32 and eliminates the time and labor required for precise positioning of said second parts 46 within any such openings. The positioning and supporting frames 38 are so dimensioned that their sides are disposed adjacent the inside surfaces of the sides of the leg 22 to center the nailing plate 28. The bottom of the trough of the U-shaped bridge member 42 is the point at which the pretensioned reinforcing steel 15 exerts a downward force on the positioning frame 38 which in turn exerts a downward and inward locking force on the U-shaped channel 28. It has been found that the application of a downwardly directed force by the steel 15 against members 42 causes the sides 40 to bow outwardly thereby increasing the securement of the frames 38 within the U-shaped sections 34.

The molding of a prestressed reinforced joist of the T-type in accordance with the invention is performed as follows. The mold is cleaned and conventional release agents are applied to the interior thereof. The assembly of nailing strip 28 and its assembled centering and hold down frames 38, with the channel-shaped nailing strip 28 being filled with expanded polystyrene or suitable material, is positioned in the end of the each leg 22 of the mold form 18. Continuous reinforcing steel 15 is then positioned in the trough of the bridge section 42 of the support frames 38 disposed in the legs. The reinforcing steel 15 is then put under tension, thus making it rigid and causing it to exert a downward force on the frames 38. The mold form 18 is then filled with concrete is properly set. After the concrete is properly set, the finished joist is removed from the mold. The ledges 14 of the joist will have the nailing strip 28 integrally molded in the ends or along the bottoms thereof, as well as the support frames 38 and the reinforcing steel 15.

Figure 5:
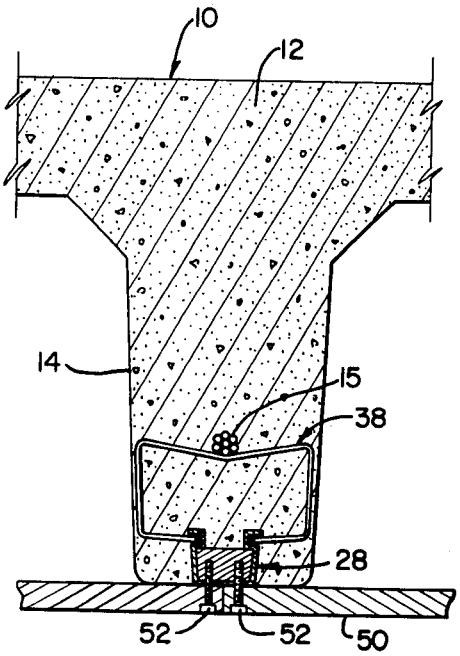
FIG. 5 is a cross-sectional view of a portion of a structural element constructed in accordance with the subject invention.

FIG. 5 shows a support ledge of the T-type joist the invention in which a ceiling or wall board element 50 is shown attached by screws 52 to the base 30 of nailing plate 28 with the screws penetrating into the penetrable area 36 and the penetrable material therein.

Figure 6:
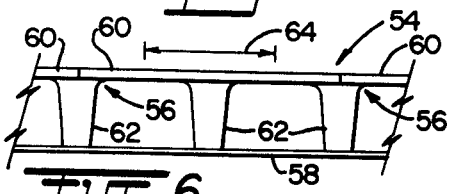
FIG. 6 is an elevational view of another embodiment of a structural element constructed in accordance with the subject invention, said element incorporating therein F-type joists.

In FIG. 6 is shown another, although generally less commonly used, embodiment of a structural element constructed in accordance with the subject invention. The structural element 54 comprises one or more prestressed, concrete, F-type joists 56, one or more sheets of material 58 and attachment means (not shown) for attaching the sheet of material to the joist 56. Each joist 56 includes a plate like body portion 60 and one or more integrally formed reinforced support ledges 62 disposed normal to the plate-like body portion 60 Each ledge 62 of the element 54 has a nailing strip (not shown) integrally molded in the end thereof. Each ledge 62 of the element 54 has a part of said plate-like body 60 associated therewith, the length of each part being indicated generally by the arrow 64, it being noted that each ledge 62 is disposed generally centrally of its associated part, taken along a line disposed normal to the longitudinal axis of said ledge. The ratio of the cross-sectional area of the part of said plate-like body portion, taken along a line disposed normal to the longitudinal axis of said ledge, to the width of its associated ledge, said width of said ledge being measured along the line of intersection of the sides of said ledge with the lower surface of the plate-like body portion, varies between approximately 7.5 to 10 inches. Although a transfer or preferably an arcuate surface may interconnect the ledges to the body portion, the width of the ledge referred to herein is limited to the distance between an extension of the sides of the ledge as aforesaid. The ratio of the cross-sectional area of each ledge to the cross-sectional area of its associated part, taken along a line dispoed normal to the longitudinal axis of said ledge, is equal to approximately two or less, and preferably to approximately one or less. The sheet of material 58 disposed adjacent the ends of the ledges 62 is formed from a material selected from the class consisting of gypsum or mineral-fiber mixture, said mixture being non-combustible. The thickness of the material used to form the sheet 58 equals approximately one-half inch or more and preferably five-eights inch or more where gypsum material is involved. It will be understood that the flames are exposed to the sheet of material 58 during the fire rating test.

Figure 7:
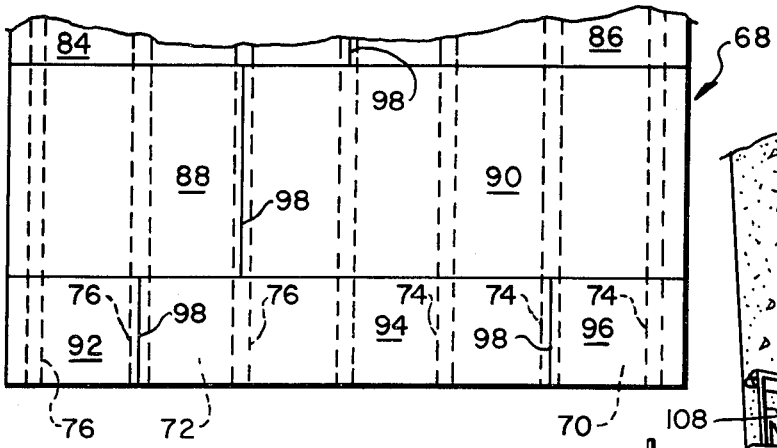
FIG. 7 is a partial view showing the reflected ceiling plan of a structural element constructed in accordance with this invention.

In FIG. 7 is shown a partial view of a structural element 68 constructed in accordance with this invention and having a fire rating of approximately 2 hours when tested with the standard time-temperature curve established by the American Standards for Testing Materials where said element has an unrestrained classification. More specifically, the structural element 68 comprises a pair of longitudinally extending prestressed concrete joists 70 and 72. One or the joists 70 has four longitudinally extending support ledges 74 while the other joist 72 has three longitudinally extending support ledges 76. A grout joint (not shown) similar to grout joint 17 shown in FIG. 1 interconnects the adjacent sides of said joist 70 and 72. Each joist inclues a plate-like body portion forming at least a part of the first side of said element 68. Each support ledge of each joist is integrally formed with the plate-like body portion of each joist disposed generally normal to said plate-like body portion. Each ledge is suitably reinforced with pretensioned steel 78, see FIG. 8, and has a nailing strip 80 integrally molded at the end or along the bottom surface of each ledge. A layer of penetrable material 82 is disposed within the channel-shaped member from which the nailing strip 80 is constructed.

The element 68 includes a plurality of sheets of material 84, 86, 88, 90, 92, 94 and 96 attached to the ends or the bottom surfaces of said ledges 72 and 74. Said sheets are formed from a material selected from the class consisting of gypsum or a mineral fiber mixture. The sheets of material form the second side of said structural element 68 and the thickness of the material from which said sheets are made equals one-half inch or more and preferably five-eighhs inches or more. Each sheet of material forms at least one butt joint 98 with an adjacent sheet of material. The butt joints 98 extend longitudinally along a portion of a corresponding one of said ledges.

Figure 8:
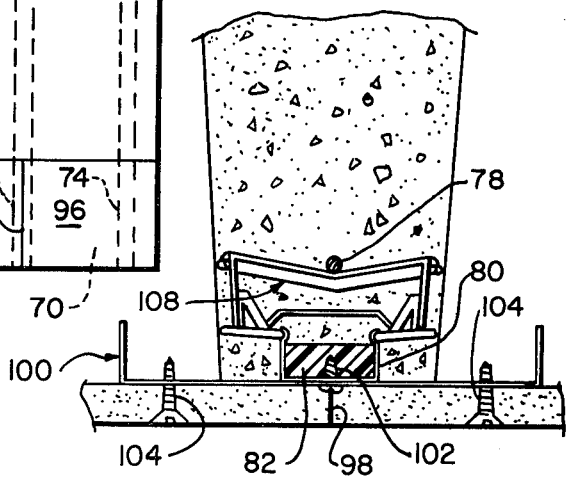
FIG. 8 is a cross-sectional view of a portion of the structural element illustrated in FIG. 7 and showing a butt joint.

The structural element 68 also includes a plurality of channel-shaped members 100, shown only in FIG. 8. The channel-shaped members 100 are disposed along each butt joint 98 and intermediate said ledge portion and said sheets of material. The channel-shaped member 100 is securely attached to the nailing strip 80 of its associated ledge through the use of attachment means 102 which extend through the bottom wall of the channel-shaped member forming the nailing strip 80 and into the penetrable layer of material 82. The bottom wall of the channel-shaped member 100 extends laterally of the opposite sides of the ledge by a sufficient amount to permit ready attachment of the sheets of materialto said channel-shaped member by attachment means 104. For example, where the width of the bottom surface of the ledge, as shown in FIG. 8, is approximately 3 to 3¼ inches, the width of the bottom wall of the channel-shaped member 100 is approximately six inches. The use of a one and one-fourth inches by six inches, 20 gauge hot dipped galvanized metal 54 inches in length to form the channel-shaped member 100 has been found to be adequate. In this connection, it must be realized that channel-shaped member 100 must be sufficiently rigid to prevent undesirable distortation of the sheets of material attached thereto during the fire rating test and, at the same time, to provide a minimum distance of approximately one and one-fourth inches between the edges of the sheets of material forming the butt joint 98 and the attachment means 104. This insures that the edges of the sheets of material will not pull away from the butt joint 98 during the fire rating test.

Figure 9:
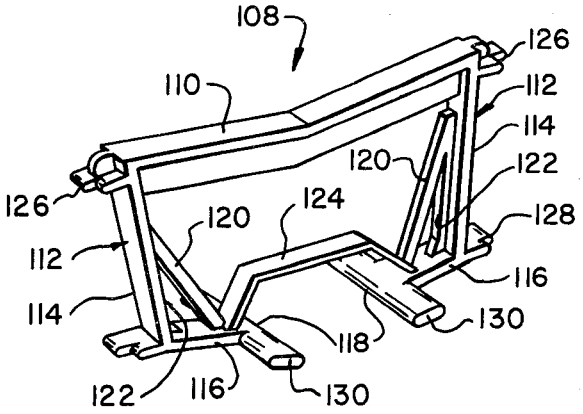
FIG. 9 is a perspective view of a preferred embodiment of a positioning member constructed in accordance with this invention.
Figure 10:
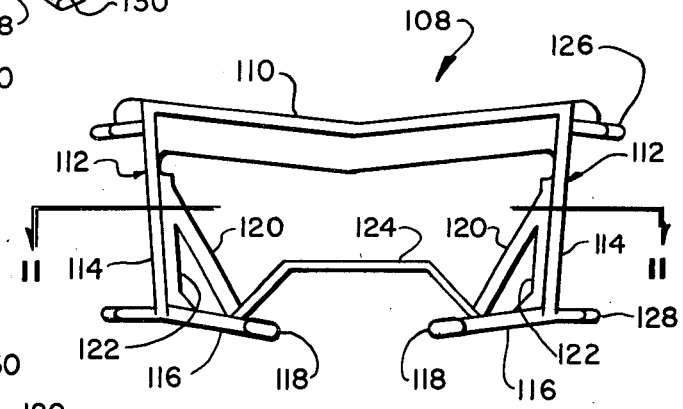
FIG. 10 is a front elevational view of the positioning member shown in FIG. 9.
Figure 11:
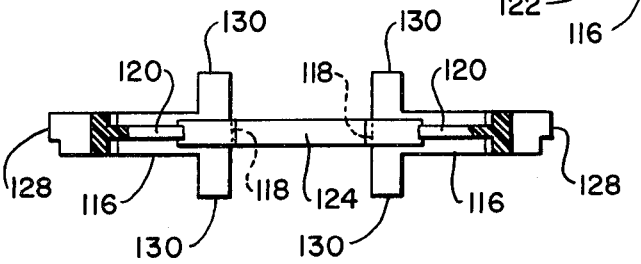
FIG. 11 is a cross-sectional view taken on line 11—11 of FIG. 10.

As shown in FIG. 8, a positioning member 108 formed from a single piece of plastic material and also shown in greater detail in FIGS. 9–11, may be used in lieu of the positioning members or frames 38 as shown in FIGS. 2–5. The positioning member 108 is made from a suitable plastic material such as polyethylene. The members are spaced longitudinally along the channel-shaped member used to form the nailing strip 80 by any suitable spacing such as approximately four feet apart. The member 108 comprises an elongate support portion 110 having an upper surface formed to position therein the pretensioning steel 78. An upper surface concave in configuration has been found to be a preferred configuration. The member 108 also includes a pair of L-shaped portions 112. Each L-shaped portin 112 includes a pair of arms 114 and 116 with arm 114 being integrally attached adjacent one end of the support portion 110 and generally depending therefrom while the other arm 116 is disposed generally parallel with the support portion 110. Each L-shaped portion 112 is constructed for limited pivotal movement, approximately 3° to 8° relative to said support portion, said pivotal movement occuring in a plane in which is disposed said support portion and said L-shaped portions. Each of the arms 114 of said L-shaped portion that are integrally attached to said support portion are convergently disposed one to the other, taken in a direction proceeding away from said support portion 110 toward the arms 116 that are disposed generally parallel with said support portion. The angle of convergence of said arms 114 equals at least approximately 4° or more and preferably approximately 6°. With the arms 114 being convergently formed as aforesaid and the L-shaped portions being mounted for limited pivotal movement relative to said support portion, it has been found that upon application of a force downwardly against the upper surface of the support portion 110 (such as occurs from contacting engagement of the pretensioning steel 78 upon the structure portion 110), the L-shaped portions 112 will pivot a limited amount, depending in part upon the amount of the applied force and the resistance encountered by the channel-shaped member used to form the nailing strip 80, when the member 108 is mounted upon the nailing strip 80. A positioning member 108 constructed in this manner has been found to be quite advantageous since the pretensioning steel 78, see FIG. 8, when positioned upon the upper surface of the support portion 110 provides a downwardly directed force thereagainst.

The free ends 118 of the arms 116 are constructed for engaging the nailing strip 80 in a manner to secure the member 108 to said nailing strip 80 as shown in FIG. 8. More specifically, as shown in FIG. 8, the channel-shaped member used to form the nailing strip 80 includes a pair of side walls each of which has a longitudinally extending U-shaped portion formed adjacent the upper edge thereof. The longitudinal axis of each U-shaped portion lies in a plane disposed generally parallel with a plane in which is disposed the bottom wall of said channel-shaped member and the bight of said U-shaped portion extends inwardly of its associated side wall.

Each L-shaped portion 112 includes stiffening means for controlling the overall stiffness thereof. The stiffening means includes a diagonally disposed member 120 having one end thereof integrally attached to each of the arms 114 (below the pivot point) and 116. The stiffening means may also include a rib 122 extending longitudinally along the inner surface of each of the arms 114 from the attachment of the member 120 to arm 114 down to the intersection of arm 114 with arm 116 where same flares out by a sufficient amount to provide increased rigidity of the intersection itself.

The member 108 also includes means 124 interconnecting a portion adjacent the free ends of each arm 116. The means 124 preferably comprises a thin strip of plastic constructed as shown. The strip of plastic is generally rectangular in cross-section and has its largest dimension, when viewed in cross-section, disposed in a plane disposed normal to the plane in which lies the support portion 110 and the L-shaped of one plastic member with another when a plurality of plastic members 108 are loosely packed in a container. It will be noted that without the use of the means 124, each of the free ends of the L-shaped portins 112 would function in the manner of a hook thereby becoming intermixed with other members 108 which would require some time on the part of the user to separate one member 108 from another such member.

As shownin FIGS. 9–11, the member 108 may also include the tab means 126 and 128 extending longitudinally outwardly of the opposite ends of the support portion 110 and longitudinally outwardly of the pair of arms 116. It will be understood that the memer 108 may be formed either with or without these tab means 126 and 128. The purpose of the tab meansis to permit the use of one size of memer 108 within leg sections 22 having different widths without the necessity of having separate molds for each member 108. The formation of member 108 either with or without such tab means, as aforesaid, is accomplished by means well known in the art of plastic items.

When tab means 126 and 128 are formed on the member 108 said tab means are preferably L-shaped, in plan form, as shown in FIg. 11. The purpose for using this configuration is to provide increased flexibility thereof adjacent the outer ends of the tab means thereby minimizing the effects of tolerance differences in the width of the leg sections 22 of various mold members 18.

The free end 118 of each of the arms 116 preferably includes a portion or portions 130 disposed generally normal to the longitudinal axis of the arm 116. The portions 130 are disposed within the same plane within which lies the free ends 118 of the arms 116. It will be understood that the portions 130 provide an additional bearing area for the member 108 when the free ends 118 and the portions 130 are disposed within the bight of the U-shaped portion formed along the upper edges of the side walls of the channel-shaped member used to form the nailing strip 80.

The outer ends of the support portion 110 and the L-shaped portions are preferably formed such that said outer ends are connected or circumscribed by a pair of convergently disposed lines, taken in a direction proceeding along said lines from said outer end of each support portion to the corresponding outer end of each L-shaped portion, such that the outer ends of said member 108 will be readily accomodated by the convergently formed sides of the leg sections 22 of the mold 18.

Although each of the positioning members described herein are suitable for the intended purpose, it has been found that the positioning member 108 formed from a plastic material is advantageous under many applications since the surface portions thereof are never coated with rust. Additionally it has also been found that the positioning member 108 is more readily attached to the nailing strip than is the positioning member 38. Thus, at the present time, the prefered embodiment for a positioning member is considered to be that shown in FIGS. 9–11.

In order for a structural element constructed in accordance with the subject invention to be used in certain applications, it must have a fire rating classification of approximately 2 hours when tested with the standard time-temperature curve established by the American Standards for Testing Materials. Two tests made on a structural element similar to that shown in FIGS. 1 and 7 (frme 38 having been used rather than member 108), one structural element measuring approximately 9 feet long by 8 feet wide, the other element measuring approximately 17 feet long by 14 feet wide, each element containing one grout joint to connect two individual T-type joists together, and the sheet of material 16 being formed from a gypsum material having a thickness of approximately five-eights of an inch, showed that such structural elements had a fire rating classification of 2 hours, the first element above described lasting 2 hours and 8 minutes before reaching a specified end point in the test and the second above described element lasting 2 hours and 11 minutes before reaching a specified end point in the test. Based upon the known fact that each additional one-eighth inch of gypsum material used is considered to extend by approximately 8 minutes the time that a structural element can withstand the fire rating test as aforespecified and since the above-referenced test exceeded the 2-hour period by eight minutes, it is concluded that a structural element constructed in accordance with the subject invention and using a sheet of material formed from gypsum in which the thickness of the gypsum is approximately one-half inch or more would meet the fire rating test requirement.

In view of the foregoing, it will be readily appreciated that a novel structural element, concrete prestressed joists of either the T-type or F-type (the terms F-type and T-type being generally used interchangeably herein), form members for use with a mold for making such joists, and positioning members have been described. It is an advantage of the subject invention that the metal nailing strip is securely embedded in the center of the end of the ledge and flush with the surface of the concrete ledge, and that same will not swell, rot, warp or the like. A nailing strip can be readily incorporated into the ledges of the joist during molding simply by dropping the assembly of nailing strip and supporting frames in the ends of the mold section in which the ledges are molded. The use of the positioning member 38 or 108 insures that the nailing strip is centrally positioned and is held down in contact with the form surface. Through the use of suitable attachment means, the sheet of material will be securely anchored to the ledges of the joist either directly or indirectly in the case of attachment adjacent the butt joints. The number of parts necessary to attach elements to the ledges of the joist is reduced to a minimum. Precise position of the attachment means longitudinally along the ledges is not a requirement since attachment of the sheet of material to the nailing strip may be effected anywhere therealong. A suitable leeway laterally of the ledges is also permitted due to the width of the nailing strips. The use of the nailing strip of this invention insures the formation and retention of a penetrable area inside same into which attachment means for structural elements can readily penetrate. The filling material, which prevents concrete from entering the interior of the nailing strip, serves the function of providing a medium into which the attachment means for the element secured to the nailing strip can penetrate. The cost of manufacturing a joist in accordance with the subject invention has been substantially reduced since the amount of concrete required is approximately one-half of that of prior art joists. For example, a joist constructed in accordance with the subject invention from 150 pounds per cubic feet concrete and having the following dimensions will weigh only approximately 35 pounds per square foot:

| | |
|---|---|
| Thickness of the plate-like body portion | 1 ½" |
| Width of joist | 8' |
| Height of ledge | 8 ½" |
| No. of ledges | 4 |
| Width of ledge measured at intersection of an extension of the sides thereof with the bottom surface of the plate-like body portion | 4" |
| Width at bottom of ledge | 3.25" |
| Cross-sectional area of ledge | 30.8 in.$^2$ |
| Nailing strip (includes ⅛" diameter U-shaped portion formed along upper edge of side walls) | 11/16" × 1⅜" |
| | 25 ga. hot dipped galvanized metal |
| Layer of penetrable material (expanded polyethylene) | ½" × 1⅜" |

I claim:

1. A structural element having a fire rating of approximately 2 hours when tested with the standard time-temperature curve established by the American Standards for Testing Materials, said elements having first and second sides, said second side during the fire rating test of said element, being exposed to flames, said elements comprising:

a. at least one prestressed concrete-joists, each joist having
   i. a plate-like body portion forming at least a part of the first side of said element,
   ii. at least one integrally formed, reinforced support ledges disposed normal to the plate-like body portion, each support ledge having a bottom end,
   iii. each ledge having a nailing strip integrally molded centrally within the bottom end thereof, each nailing strip including a penetratable area formed internally adjacent thereof;

b. a plurality of sheets of material disposed adjacent the bottom ends of said ledges, said sheets being formed from a material selected from the group consisting of gypsum and a mineral fiber mixture, said sheets forming the second side of said element, the thickness of the material forming said sheets equalling at least one-half inch, each sheet of material forming at least one butt joint with an adjacent sheet, said butt joint extending longitudinally along the nailing strip within the bottom end of one of said ledges;

c. a plurality of metal channel-shaped members, each channel-shaped member being disposed along the length of each butt joint and intermediate said ledge bottom end and said sheets,
   i. each channel-shaped member projecting laterally beyond the opposed sides of the nailing strip;

d. driven attachments means attaching said channel-shaped members to the nailing strips of said ledge bottom ends; and e. additional attachment means attaching said sheets of material to said channel-shaped members laterally outward of the butt joint and of both sides of the nailing strip, said additional attachment means, channel-shaped members and nailing strips cooperating to secure the sheets to said joists while preventing undesirable distortion or warping thereof during the fire rating test.

2. A structural element as defined in claim 1 in which each of the additional attachment means used to attach the sheets of material to the channel-shaped members disposed along said butt joints is disposed a minimum distance of approximately one and one-fourth inches from the adjacent edge of each sheet.

3. A structural element as defined in claim 1 in which each ledge of each joist has a part of said plate-like body portion associated therewith i. each ledge being disposed generally centrally of said associated part taken along a line disposed normal to the longitudinal axis of said ledge, ii. each part extending laterally of both sides of its associated ledge, taken along a line disposed normal to the longitudinal axis of its associated ledge to a point midway between said associated ledge and an adjacent ledge or the end of said plate-like body portion, whichever is the closer, iii. the ratio of the cross-sectional area of the part of said plate-like body portion taken along a line disposed normal to the longitudinal axis of said ledge, to the width of its associated ledge, said width of said ledge being measured along a line disposed normal to the longitudinal axis of said associated ledge at the line of intersection of said ledge with said part, varying between approximately 7.5 to 10 inches, and iv. the ratio of the cross-sectional area of each ledge to the cross-sectional area of its associated part, taken along a line disposed normal to the longitudinal axis of said ledge, being equal to approximately two or less.

4. A structural element as defined in claim 3 in which the ratio of the cross-sectional area of the part of the plate-like body portion to the width of its associated ledge varies between approximately 8 to 9 inches, and the ratio of the cross-sectional area of each ledge to each cross-sectional area of its associated part is equal to approximately one or less.

5. A structural element as defined in claim 1 in which said sheets are formed from a gypsum material wherein the thickness of said gypsum material equals approximately $\frac{5}{8}$ inches or more.

6. A structural element as defined in claim 1, wherein the channel-shaped members project beyond opposed sides of the ledges, said additional attachment means being disposed laterally outward of the opposed sides of the ledges.

* * * * *